US007640939B2

(12) United States Patent
Ploix

(10) Patent No.: US 7,640,939 B2
(45) Date of Patent: Jan. 5, 2010

(54) CURLER FOR NATURAL SECTION OF HAIR

(75) Inventor: Dominique Ploix, Paris (FR)

(73) Assignee: L'Oreal, Paris (FR)

( * ) Notice: Subject to any disclaimer, the term of this patent is extended or adjusted under 35 U.S.C. 154(b) by 144 days.

(21) Appl. No.: 11/106,679

(22) Filed: Apr. 15, 2005

(65) Prior Publication Data

US 2005/0236010 A1 Oct. 27, 2005

Related U.S. Application Data

(60) Provisional application No. 60/566,422, filed on Apr. 30, 2004.

(30) Foreign Application Priority Data

Apr. 16, 2004 (FR) ..... 04 04076

(51) Int. Cl.
*A45D 2/12* (2006.01)

(52) U.S. Cl. ..... 132/226

(58) Field of Classification Search ..... 132/226, 132/245, 246, 247, 253, 267, 268
See application file for complete search history.

(56) References Cited

U.S. PATENT DOCUMENTS

| | | | | | |
|---|---|---|---|---|---|
| 1,636,967 | A | * | 7/1927 | Perry | 132/211 |
| 1,684,774 | A | * | 9/1928 | Montealegre | 132/246 |
| 1,693,005 | A | * | 11/1928 | Steichen | 132/246 |
| 1,743,695 | A | * | 1/1930 | Tubbs | 132/226 |
| 1,884,306 | A | * | 10/1932 | Shelton | 132/226 |
| 1,886,909 | A | * | 11/1932 | Santurello | 132/226 |
| 1,889,227 | A | * | 11/1932 | Sterling | 132/226 |
| 1,921,861 | A | * | 8/1933 | Baldwin | 132/226 |
| 1,944,417 | A | * | 1/1934 | Everett | 132/226 |
| 1,968,593 | A | * | 7/1934 | Baldwin | 132/226 |
| 1,974,460 | A | * | 9/1934 | Isaacs | 132/246 |
| 1,988,953 | A | * | 1/1935 | Molchan et al. | 132/226 |
| 2,008,656 | A | | 7/1935 | Cooper | |
| 2,088,272 | A | * | 7/1937 | Agnes | 132/226 |
| 2,374,860 | A | | 5/1945 | Garrison | |
| 2,404,867 | A | * | 7/1946 | Simons et al. | 132/246 |

(Continued)

FOREIGN PATENT DOCUMENTS

| | | |
|---|---|---|
| FR | 988 142 | 8/1951 |

(Continued)

*Primary Examiner*—Robyn Doan
*Assistant Examiner*—Rachel R Steitz
(74) *Attorney, Agent, or Firm*—Oblon, Spivak, McClelland, Maier & Neustadt, L.L.P.

(57) ABSTRACT

A curler having a body with a longitudinal axis designed to have a section of hair wound about it, and a foot integral with a first axial end of the body and having a surface capable of resting on the scalp. This surface preferably has a surface area greater than the surface area of a transverse section through a part of the body capable of having the section of hair wound about it. The foot includes means capable of retaining a portion of the section of hair that is not wound about the body. In addition, the body has an arm capable of occupying, for example by deformation of the arm and/or the body, a position in which the arm keeps the section of hair wound around part of the body.

47 Claims, 2 Drawing Sheets

U.S. PATENT DOCUMENTS

| | | | | | |
|---|---|---|---|---|---|
| 2,508,374 | A | * | 5/1950 | Cipolla | 132/243 |
| 2,642,072 | A | * | 6/1953 | Cipolla | 132/243 |
| 2,867,223 | A | | 1/1959 | Anzalone | |
| 2,903,000 | A | | 9/1959 | Angelaccio et al. | |
| 4,211,245 | A | * | 7/1980 | Coppola et al. | 132/268 |
| 4,577,647 | A | | 3/1986 | Fenster et al. | |
| 4,955,401 | A | * | 9/1990 | Parsons | 132/262 |
| 5,483,980 | A | | 1/1996 | Lin | |
| 6,408,858 | B1 | * | 6/2002 | Emmons et al. | 132/247 |

FOREIGN PATENT DOCUMENTS

| | | |
|---|---|---|
| FR | 2 146 690 | 3/1973 |
| GB | 310242 | 4/1929 |
| JP | S53-68388 | 6/1978 |
| JP | 61-110302 | 7/1986 |
| JP | H06-017601 | 3/1994 |

* cited by examiner

CURLER FOR NATURAL SECTION OF HAIR

CROSS-REFERENCE TO RELATED APPLICATIONS

This document claims priority to French Application Number 04 04076, filed Apr. 16, 2004 and U.S. Provisional Application No. 60/566,422, filed Apr. 30, 2004, the entire content of which are hereby incorporated by reference.

BACKGROUND OF THE INVENTION

1. Field of the Invention

The present invention relates to a curler for shaping a section of hair. The arrangement can be particularly advantageous for providing a more uniform treatment of the hair, or where it is desirable to not treat a portion of this section of hair near the root.

2. Discussion of Background

In the prior art there are conventional curlers made up of a generally cylindrical rigid part about which a section of hair is wound, a pin being pushed through both the wound hair and the said rigid part in order to prevent the said section of hair unwinding. One problem with these curlers arises particularly when the user tries to wind a section of long hair onto a curler of this kind. If the whole length of the section of hair is wound onto one curler, the hair will have to be wound in several thicknesses. However, this arrangement in which the hair is overwound on top of itself is detrimental to penetration of the product which is then applied to the hair. Consequently, in order to wind a section of long hair and allow the product to penetrate fully into the section of wound hair, the hair is usually wound onto several curlers, one after the other along the length of the hair. The number of curlers required is then multiplied by two or three, and the time spent putting the hair in curlers is increased by a similar amount.

Many alternative curlers are known. U.S. Pat. No. 5,483,980 discloses a curler having a cylindrical rigid part about which a section of hair can be wound, with a half-cylindrical shell hinged to one end of this rigid part so that at the right moment it can be closed onto the outer perimeter of the cylindrical rigid part. This shell is kept in its closed position on the rigid part by a supplementary bending of a deformable rigid element projecting from the other end of the rigid part.

Moreover, if the user wants to have curly hair with "natural" effect but without causing the hair on the top of the head to be puffed up, hair growing on the top of the head must not be wound all the way to the roots. Winding therefore begins preferably at the end of the hair and stops short of the roots or conversely stops short of these roots. The curlers now hang at the respective ends of the unwound portions, near the roots, of these sections of hair. The curlers lie all the way around the top of the head, exaggerating the profile of the head. The difficulty is that the unwound portions must not be looped up, and the curlers must not be placed on top of the head if the "natural" effect is to be achieved. The person thus has hair done up in curlers hanging unattractively around the face until the curlers are taken out.

For users with long hair, furthermore, the weight of each curler, together with the corresponding wound up portion of hair, pulls on the roots of the hair. This is a well-known source of discomfort for users with long hair.

Particular curlers that have these disadvantages are known from documents U.S. Pat. No. 2,374,860; FR-2 146 690; U.S. Pat. No. 2,008,656 and FR-988 142.

SUMMARY OF THE INVENTION

It is an object of the invention to solve at least one of the problems set forth above by providing a curler that is simple and quick to use. Preferably, the arrangement can allow complete winding of a section of long hair, and/or can give an attractive appearance to the face of the person wearing it. A curler according to the invention has a body with a longitudinal axis (X) designed to have a section of hair wound about it, and a foot integral with a first axial end of the body and having a surface capable of resting on the scalp. This surface has a surface area greater than the surface area of a transverse section through a part of the body capable of having the section of hair wound about it. The foot has means capable of retaining a portion of the section of hair that is not wound about the body. The body has an arm capable of occupying, by deformation of the body, a position in which the arm keeps the section of hair wound around the part of the body.

The surface intersects, for example at right angles, the longitudinal axis of the body.

Advantageously, the foot can have a slit in which the portion of the section of hair is retained. For example, the slit may be formed through the foot in such a way that the section of hair is inserted by sliding it along an axis of the section of hair. Preferably, however, the slit opens out at a border of the foot, and has an entrance accessible from this border. The section of hair may then be inserted in a translatory manner, in a direction substantially orthogonal to an axis formed by the said section of hair. For example, the entrance to the slit can then be chamfered to ease the insertion of the hair into the slit. In a variant, the slit can form a V-shaped indentation in the foot, so that a space between the two arms of the V defines the entrance through which the hair is introduced relative to the curler. In this variant a junction region between the two arms of the V corresponds to the bottom of the slit, in which the section of hair can be retained. Advantageously, the slit opens out from the foot at a distance from a junction between the body and this foot. Since the foot forms an angle other than zero with the longitudinal axis of the body, the first portion of the section of hair retained in the foot is continued by a second portion of hair extending between the foot and the body, about which body the rest of the section of hair will then be wound. With this arrangement it is possible for the first and second portions of the section of hair to not be wound about the body so that they will not form curls.

The foot is preferably arranged so that the first portion, and if appropriate the second portion, are close to the roots of the section of hair to be wound about the curler. For example, the foot can be arranged so that the surface intended to be placed on the scalp enables the first portion of the section of hair to be held straight out from the scalp. The foot in this case can preferably have a slit in which the portion of the section of hair is retained, this slit extending inter alia as far as this surface. The slit can be defined in a plane, in which case this plane preferably forms an angle other than zero with the surface of the foot so that the section of hair inserted into this slit also forms an angle other than zero with the scalp. The section of hair is therefore held out away from the scalp.

The thickness of the foot is equal to a minimum length of a portion of the section of hair that can be retained straight out from the scalp. For example, the portion of the section of hair retained in the foot can be held out at 90° relative to the scalp.

The body has for example a portion that extends sideways beyond the perimeter of the body.

Advantageously, the means, formed in the foot, for retaining a portion of the section of hair are preferably elastically deformable. They can therefore close elastically on the portion of the section of hair to grip it by elastic stress. Where these means take the form of a slit, the slit can have two opposing borders, which may for example be in contact when at rest, and which can be elastically separated from each other. Once a section of hair has been inserted into the slit, the two borders tend to return to their initial rest position, to constrain and retain a portion of the section of hair lying between these two borders.

The body is preferably at least partly made of an elastically deformable material, for example an elastomer or a foam. The foam may be an open-cell or closed-cell foam. A lightweight material such as a foam is preferred. Where appropriate, the outer perimeter of the foam preferably has open cavities: this improves the engagement and retention of the hair in the curler.

By way of example, the foot and the body can advantageously be made of the same material. Still more advantageously, the whole curler can be made of a single material, thus simplifying the compatibility testing of the curler for a whole range of products that could be applied to the hair when wound about the said curler.

In one particular embodiment, by way of example, the foot can be essentially parallelepiped in shape and have a main axis of elongation. This main axis of elongation then forms an angle other than zero with the longitudinal axis of the body.

By way of example, the foot can advantageously be joined to one end of the body relative to the longitudinal axis. If the body and the foot are each essentially a parallelepiped in shape, then the overall shape of the curler is an L, especially in the case of embodiments in which the longitudinal axis of the body is at right angles to one surface of the foot.

Also by way of example, the foot can be advantageously adhesively bonded to the body. Alternatively it can be welded, for example, by ultrasonic welding or heat sealing, to the body. In another variant the foot and the body are monolithic.

A curler according to the invention is preferably produced by stamping. For example, the body and the foot can be stamped out of a panel having at least two flat faces parallel with each other, which are then joined together at a later stage.

The body preferably has an outer perimeter capable of facilitating the winding of the section of hair. For example, the body is at least partly screw-threaded so that the screw thread of the body guides the winding of the hair. In a variant, the body can be at least partly toothed, in which the teeth are preferably spaced out at regular intervals on the surface of the body for example. If the body is essentially a parallelepiped, it preferably has at least two opposing toothed surfaces, in which case the teeth on these two surfaces may alternate so that a tooth on one side is opposite an indentation situated between two teeth on the other side.

The section of hair is preferably wound helically about the longitudinal axis of the body.

The curler advantageously comprises an impermeable outer wall to prevent product impregnated into the section of hair from being absorbed by the curler which could result in the section of hair being applied with a limited quantity of applied product. This arrangement promotes more optimal impregnation Advantageously, if the section of hair is fully wound about the body, starting at the roots and working towards the ends, these ends can be held in place on the curler by the arm. The arm is usually situated at a second axial end of the body, along the longitudinal axis, remote from the first axial end of the body where the winding began, and in particular at the opposite end from where the foot is attached to the body. To keep the winding in position, the arm is moved from a first position to a second position relative to the body in such a way that an end of the wound section of hair is held in place in the second position, gripped between the arm and a part of the body.

The body preferably includes a stiffener capable of being deformed semi-permanently, in particular so as to maintain the deformation of the body allowing the arm to keep the section of hair wound about the part of the body. When the body is deformed, the stiffener is also deformed in such a way that the body extends along several consecutive segments which may intersect each other. For example, the stiffener can include a long thin core, which is stiff but nonetheless deformable, for example a copper wire, inside the body and elongated along the longitudinal axis. The stiffener is preferably designed to come to the surface at the first end of the body where it is masked by the foot.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A clearer understanding of the invention will be gained from reading the following description in conjunction with the accompanying figures. The figures are offered purely as a guide and in no way limit the invention.

DETAILED DESCRIPTION OF THE PREFERRED EMBODIMENTS

Figure 1:
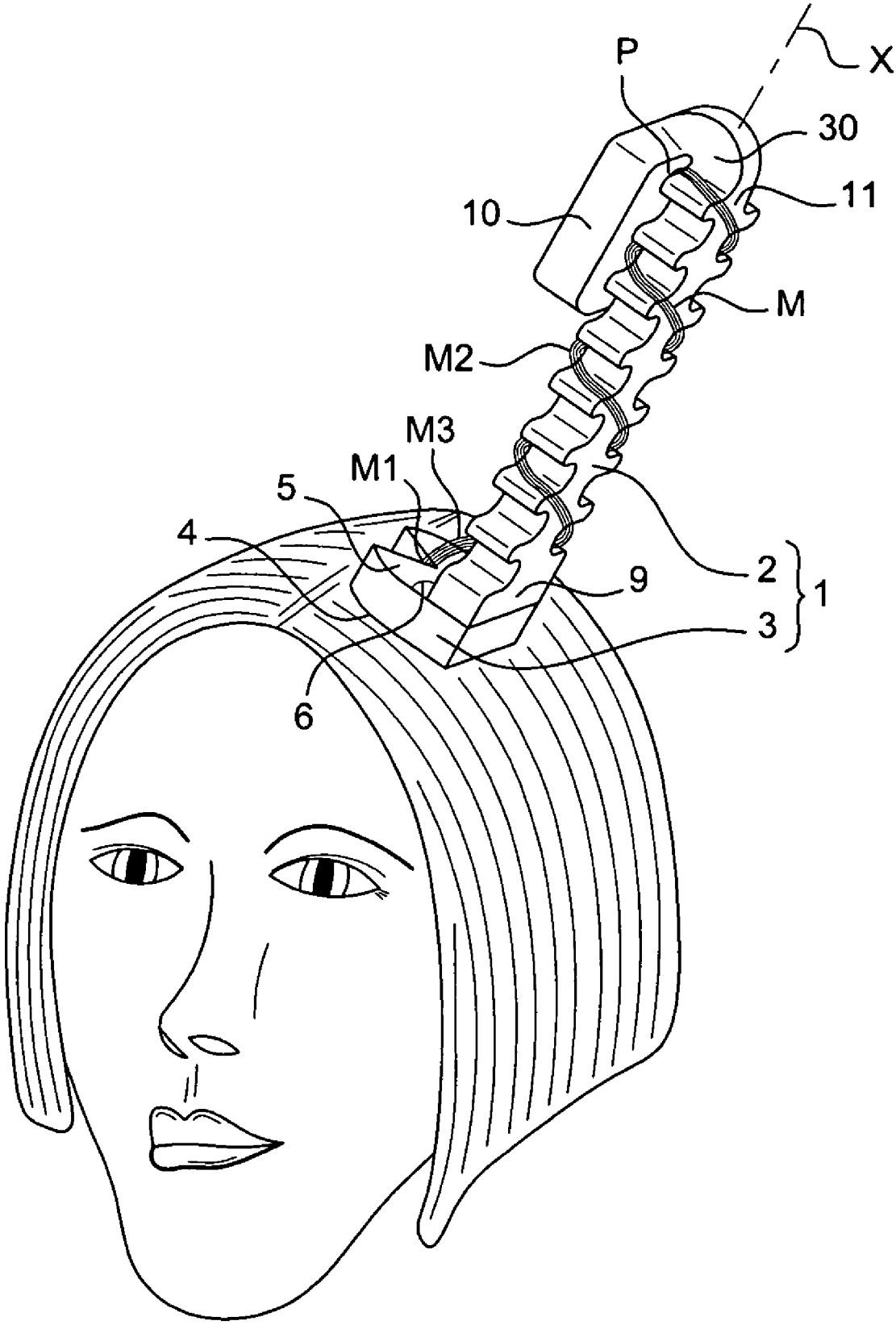
FIG. 1 illustrates a curler according to the invention in position on a section of hair.

Referring now to the drawings, like reference numerals are utilized to designate identical or corresponding parts throughout the several views.

FIG. 1 shows an example of a curler 1 according to the invention in place on a section M of hair of a user. The curler 1 has a body 2 with a longitudinal axis X corresponding also to a main axis of elongation of this body 2. In the embodiment shown, the body 2 is essentially a parallelepiped in such a way that the longitudinal axis X is parallel to the greatest length of this parallelepiped. The section M of hair is wound into spirals around the body 2. The body 2 preferably has rounded edges so as not to create sharp curves in the hair at numerous points about the body 2. The outer perimeter of the body 2 will be detailed below.

As illustrated in the example of FIG. 1, the body 2 is positioned relative to the user's head, and in particular relative to that zone of the head from where the section M has been isolated, in such a way that the longitudinal axis X is approximately perpendicular to this surface of the head. Since the section M selected here is on the top of the head, the body 2 extends from the head along the longitudinal extension of the face. When all of the hair has been divided into sections such as M and wound onto individual curlers such as 1, the user's face will be surrounded with spikes extending radially from the outer perimeter of the head, like the spikes of a hedgehog. The curlers now lie like petals around the head.

To keep the body 2 in position relative to the user's head, the curler 1 has a base part 3 forming a foot by which the curler 1 is applied to the head. This base part or foot 3 is integral with the body 2 in the illustrated example.

In the illustrated example, the foot 3 has a first surface 4 designed to be oriented to face the head and a second surface 5 on which a junction may be formed with the body 2. The longitudinal axis X can be perpendicular to this second surface 5. In the example illustrated, the foot 3 includes a shape cut from an essentially parallelepiped support, the surfaces 4 and 5 here being rectangles and parallel to each other, and the body 2 stands at a right angle to the second surface 5—so it stands at a right angle to the area of the head against which the first surface 4 is applied, from where the section M of hair is taken.

In the illustrated example, the body 2 has a portion about which the hair is to be wound. This portion has, for example, a circular, triangular, square or more generally polygonal transverse section, in a plane perpendicular to the longitudinal axis X. The transverse section of this portion of the body 2 can have a surface area S1 that varies along the axis X. In all cases the surface area S1 is less than the surface area S2 of the first surface 4. The surface area S2 preferably is more than twice the surface area S1. Thus, the surface 4 protrudes beyond the width of the body 2.

Figure 2:
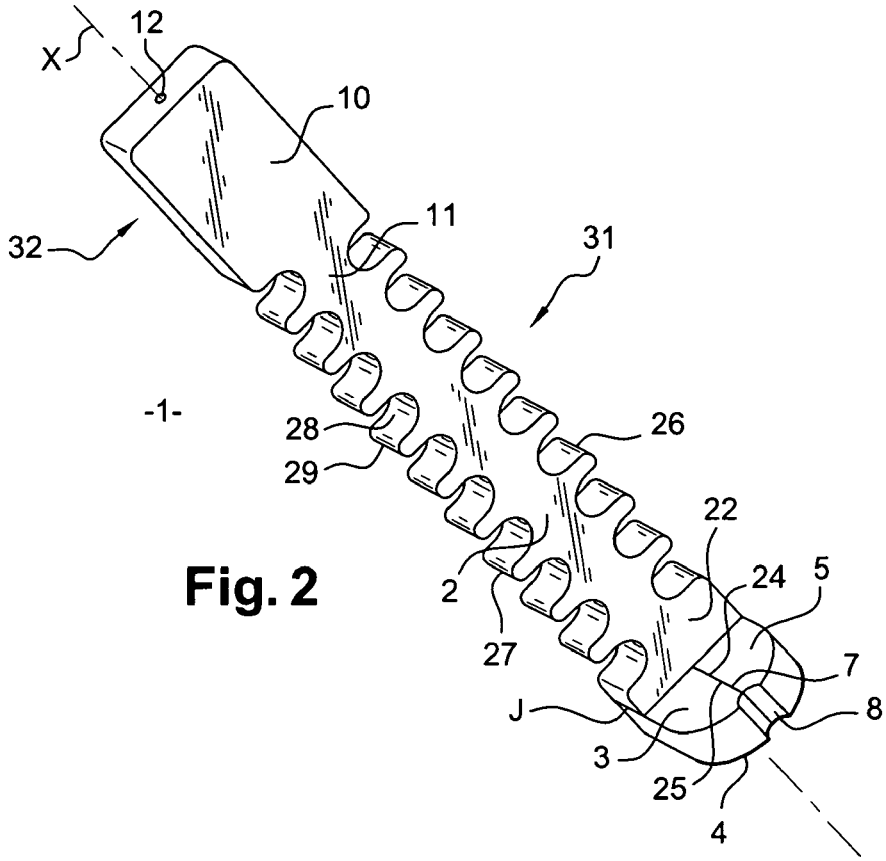
FIG. 2 is a side perspective view of a curler according to the invention.
Figure 3:
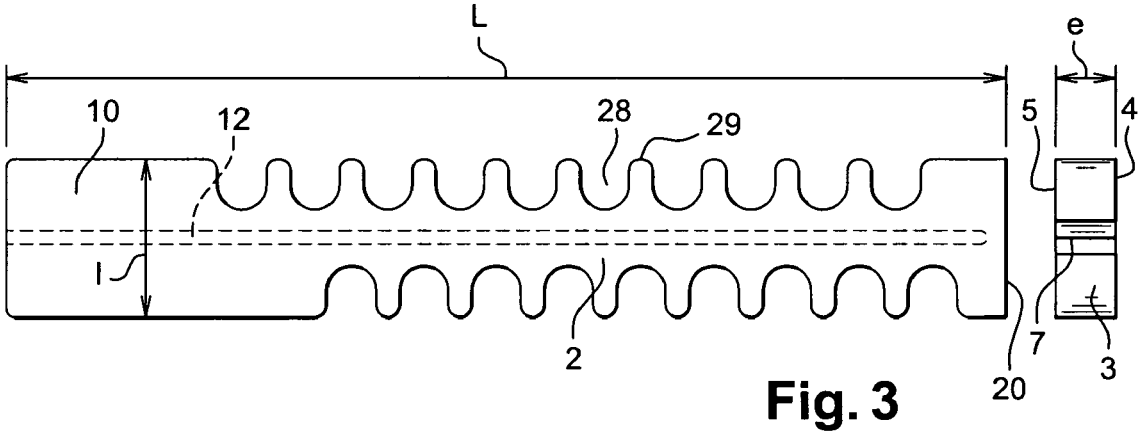
FIG. 3 is an exploded top view of a curler according to the invention.

Consequently, and particularly when the longitudinal axis X is perpendicular to this surface 4, the foot 3 projects sideways from at least one side of the body 2, as shown in FIGS. 1 to 3. In a variant, the body 2 may also be retained on the upper surface 5 at a distance from the borders of this surface.

In FIGS. 1 to 4, an angle 6 (illustrated in FIG. 1) formed between the foot 3, and more particularly between the second surface 5 of this foot 3, and the longitudinal axis X is 90°. If the foot 3 has a main axis of elongation, this main axis of elongation thus forms an angle other than zero with the longitudinal axis X, which may for example be approximately equal to the angle 6.

If it is desired to offer customers a projecting but irregular orientation of the spikes formed by the curlers relative to the head according to the invention when arranged in the hair, the curler 1 may alternatively be offered with an angle other than zero but not 90° between the foot 3 and the longitudinal axis X of the body 2.

The foot 3, which is preferably placed next to the roots of the section M, has means for retaining a portion M1 of this section M, especially near the roots. In the illustrated example, the portion M1 of the section of hair is inserted into a slit 7 formed through the thickness of the foot 3. The thickness of the foot is equal to a distance determined between the surfaces 4 and 5. If the surfaces 4 and 5 are parallel, the thickness is constant. The thickness chosen for the foot 3 is preferably such that the length of the portion M1 of the section that can be retained in the slit 7 is significantly long, to ensure that this portion M1 of the section cannot be wound about the body 2. The foot 3 can also be produced with a variable thickness.

Preferably, various embodiments of a curler according to the invention provide the means 7 capable of retaining the portion M1 of the section, and in particular the slit 7, at a location formed in the foot 3 which is at a distance from the body 2. The slit 7 may nonetheless extend through the foot 3 as far as a junction J between this foot 3 and the body 2.

In an embodiment shown in FIGS. 1 to 3, a first axial end 9 of the body 2, relative to the longitudinal axis X, is permanently fixed to the upper surface 5 of the body 3. A face 20 presented at this first end 9 is defined as perpendicular to the longitudinal axis X. It may be welded to a region 21 of this second surface 5, particularly in cases where the angle 6 is intended to be approximately 90°.

In a variant (not shown), the body 2 could also be permanently fixed to this foot 3 by welding a portion of an outer wall 22 of the body 2 located at this first end to an edge 23 of the foot 3. The edge 23 connects the surfaces 4 and 5 to each other, and the wall 22 is preferably parallel to the longitudinal axis X.

Whatever materials are used to produce the body 2 and/or the foot 3, the junction region J defines the angle 6 (illustrated in FIG. 1) between the foot 3 and the longitudinal axis X, and also maintains the angular position of the foot 3 relative to this longitudinal axis X. The winding of a section around the curler 1 does not significantly modify this angular position. At any time during the life and use of a curler 1 according to the invention, the angular position between the body 2 and the foot 3 preferably remains essentially unchanged.

In the example shown in FIG. 1, the means for retaining the portion M1 of the section of hair on the foot 3, and therefore not wound around the body 2, take the form of the V-shaped slit 7, with the portion M1 of the section being placed in the indentation of the V. The portion M1 of the section is held in this indentation by the fact that the rest M2 of the section is then wound around the body 2 in order to furthermore keep its winding in position and consequently also keep the portion M1 in position in the slit 7. The opening of the V facilitates the placement of the foot 3 on the head relative to the section M.

In a variant, as shown from example in FIGS. 2 to 4*b*, the means 7 for retaining the portion M1 of the section can take the form of the slit 7 formed in the thickness of the foot 3. This slit 7 has borders 24 and 25 practically in contact with each other. In this form, the foot 3 is preferably made of an elastically deformable material so that the borders 24 and 25 can be separated from each other to allow the portion M1 of the section of hair to be inserted. In this version, following insertion of the section, the borders 24 and 25 remain slightly separated, but tend at all times to return to their initial position of contact. This helps to keep the portion M1 in position.

The slit 7 preferably passes all the way through the thickness and thus in particular extends all the way from the first surface 4 to the second surface 5, and also to the edge 23 connecting these two surfaces. In particular, the slit 7 is defined in a plane perpendicular to the surface 4 and 5, passing for example through or parallel to the longitudinal axis X.

To put a curler 1 of this kind in position, the section M of hair is raised from the head, and the curler 1 is moved translationally at right angles to an axis of the section of hair in such a way that the section is presented to an opening or entrance 8 of the slit 7, and such that the continuation of this translational movement continues the insertion of the section M into this slit 7 from this entrance 8. The entrance 8 of the slit 7 is preferably chamfered to facilitate the insertion of the section M, especially when the borders 24 and 25 are in contact with each other. Preferably also, as shown in FIG. 4*b*, the slit 7 can have a housing 40 where the borders 24 and 25 are not in contact but rather define a space in which the selected section can be positioned, with this space also being closed by the elastic return of the borders 24 and 25 to each other. This housing 40 enables a larger diameter section of hair to be accommodated, thus reducing the number of sections required to curl all of the user's hair.

If the indentation of the slit 7, in which the portion M1 of the section will be held, is at a distance from the body 2, an intermediate portion M3 of the section emerging from the slit 7, in the continuation of the portion M1, is likewise not wound around the body 2, this intermediate portion M3 having a minimum length equal to the distance between the indentation of the slit 7 and the body 2. Because of the foot 3, this intermediate portion M3 is also not wound about the body 2.

By way of example, to simplify the production of a curler 1 according to the invention, the foot 3 and the body 2 can both be stamped out of one panel of one material, and then joined together. Such a panel preferably has two flat faces parallel with each other. The parts of the curler are cut out in such a way that a width of the body 2, measured at right angles to the longitudinal axis X, is approximately equal to a width of the foot 3. In this way a multitude of curlers can be stamped out of one panel and waste reduced. The thickness e of this panel from which the body 2 and the foot 3 are stamped may be about 12 mm.

The body 2 has in one particular embodiment, by way of example, a length L along the longitudinal axis X of about 205 mm, and a width l perpendicular to this longitudinal axis X of about 30 mm. In this embodiment the surface area S1 of a transverse section through the body 2 is about 3.6 $mm^2$. For example, the surface 4 is about 35 mm long and about 30 mm wide, and has at least one rounded perimeter in the example shown in FIGS. 2 to 4*b*. In this embodiment the surface area S2 of the surface 4 is greater than a minimum of 8 $mm^2$. The ratio of the surface area S1 to the surface area S2 is less than 1, and preferably between 0.2 and 0.8, and preferably between 0.4 and 0.6, and still more advantageously about 0.5.

Alternatively, the body 2 and the foot 3 may be made of different materials. Alternatively again, the body 2 and the foot 3 may be monolithic and cut from a block forming a solid body to form a single part.

Also by way of example, the body and foot can each be made of foam, e.g., a polyvinyl chloride (PVC), polyurethane, polyether or polyester foam, or a foam elastomer of the type comprising: natural rubber (NBR) or synthetic rubber (SBR), or butyl, silicone, nitrile or EPDM (ethylene-propylene-diene monomer copolymer) rubbers and preferably comprises at least 10% of open cells. In a first embodiment, the body 2 can be made from a closed-cell foam. Products cannot therefore become as readily impregnated into the foam, and the foam thus has a natural rigidity facilitating uniform winding. Alternatively the body 2 may also be made from an open-cell or semi-open cell foam and thus be able to absorb and retain the product on contact with the section of hair.

If the curler 1 is made from foam panels, the stamped walls have good adhesion and good grip for the hair placed on them, for example, with the cells of the foam being open. As a variant, a different way of cutting the panel may result in the outer walls of the curler being impermeable.

In one particular embodiment presented in FIGS. 1 to 4*b*, the foot 3 has a rounded outer perimeter broken by the presence of the slit 7. The entrance 8 of the slit 7 is at a distance from the junction with the body 2.

Figure 4A:
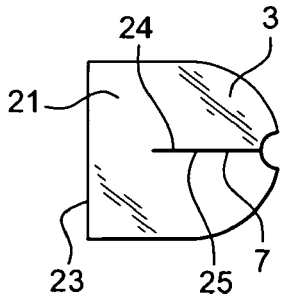
FIGS. 4*a* and 4*b* are top views of variants of a foot for a curler according to the invention.
Figure 4B:
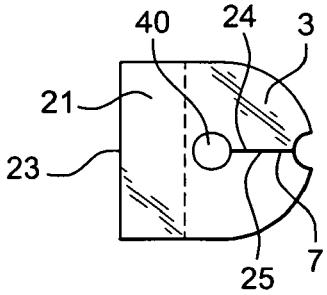

In the embodiment shown in FIGS. 2 to 4, the slit 7 is defined as far as the junction region J, while from the embodiment shown in FIG. 1 the slit 7 is entirely defined at a distance from this junction J. Alternatively, the entire slit shown in FIGS. 2 to 4 may also be formed at a distance from this junction.

Along the body 2 in the arrangement illustrated, the edges defined along the longitudinal axis X advantageously have surface irregularities for at least part of their respective lengths. For example, the body 2 has at least one toothed wall 26, preferably at least two toothed walls 26 and 27, one opposite the other, as illustrated in FIGS. 2 to 4. By way of example, the stamping out of a body with a toothed profile such as this is a simple matter and can be done in one step.

In particular, the teeth are made regular and/or produced in such a way that a depression such as 28 in one of the walls has a reflection about the longitudinal axis X in the form of a projection such as 29 in the other of the opposing walls. In other words, the teeth on different sides of the body are offset with respect to each other. Such an arrangement of alternating teeth forms a crude screw thread, it being preferably for the body 2 to be configured to allow a helical winding of the rest M2 of the section. The teeth may be such that a distance between two consecutive projections such as 29 on one wall is roughly equal to an average maximum diameter of a section of hair to be wound on such a curler. For example, this distance may be about 15 mm.

As a variant, the body 2 may have a screw thread on its outer perimeter to facilitate this helical winding.

The section of hair can thus be wound helically about the body 2. The winding pitch may be continuous or variable, and fine or coarse if the design of the teeth of the body 2 allows a choice between close winding with little or no gaps between the teeth, on the one hand, or, on the other hand, looser winding as depicted in FIG. 1.

Such helical winding of the section about the body 2 produces curls increasingly distant from the first end 9. At the end of the winding the end P of the section M is preferably wound in a material such as e.g. aluminum foil or an end paper, and this end P is then secured by means of an arm 10 attached to the body 2.

The arm 10 is formed at a second axial end 11 remote from the first end 9 relative to the longitudinal axis X. The arm 10 is configured to be able to occupy a first position in which winding is possible and a second position in which the arm occupies, relative to an intermediate part of the body 2 situated between the two ends 9 and 11 at about which the section is wound, a position which permits a portion of this section to be gripped between the arm 10 and the intermediate part of the body 2. Between the ends 9 and 11, along the longitudinal axis X, the body has a so-called "intermediate" part about which the section is wound, with this intermediate part being situated near the first end 9, and a part forming the arm 10 is situated near the second end 11.

This arm 10 is initially shaped, in a first position, in such a way that a main axis of elongation of the arm coincides with the longitudinal axis X. Particularly when the body 2 is made of an elastically deformable material, in order to keep the arm 10 in a position such that it grips the section M, the body 2 has a stiffener 12 that can be deformed in a semi-permanent way, for example, with the stiffener not having shape memory. Hence, when the body 2, and specifically the part forming the arm 10, are bent into a second position, this second position is then maintained by the presence of this stiffener, and a portion of the section M of hair can also be held in position by being gripped between the intermediate part of the body and this arm 10.

In the example illustrated, the stiffener 12 can be a wire, such as a copper wire extending along the longitudinal axis X through the body 2. The copper wire may for example be retained by a spot of adhesive inside the body 2. The wire is preferably shorter than the body 2 so as not to project visibly from the outer perimeter of the body.

By way of example, in order to clamp the end P, the arm 10 is rotated through an angle of 180° at a bending point 30 somewhere near where the end P is located on or coupled to the body 2. The bending point 30, which may be chosen at will along the longitudinal axis X, separates the intermediate part about which the section is wound from the part forming the arm 10.

If the user has shorter hair this bend can be made in the toothed region 31 of the body 2. If on the other hand the user's hair is long enough to be wound all the way to the last tooth of this toothed region 31, the bend can be made at the limit between the toothed region 31 and the toothless region 32. Thus, as should be apparent, by selectively deforming the body and/or the arm, the clamping location between the body and the arm can be selected at various locations along the length of the body. Thus, plural clamping locations can be selected as desired by deformation of the body and/or the arm.

By way of example, the toothed region 31 of the body 2 represents two thirds of the length of the body 2 relative to the longitudinal axis X, and the toothless region 32 forms the last third of the length of this body 2. As a variant, the body 2 may have teeth all the way along or may have no teeth at all, and any other distributions of the toothed and toothless regions can also be provided within the scope of the invention.

When it is time to take the curlers out, when the product applied to the wound hair sections has done its work, the curler 1 is removed by opening the arm 10 out from its second position to release the end P. Next, the portion M2 is unwound, and finally the portion M1 is disengaged from the foot 3. The arm 10 can then be placed in a third position differing from the first position, such that it no longer lies in the continuation of the longitudinal axis of that part of the body 2 designed to take the wound sections.

In an alternative embodiment, the foot 3 projects from one side of the body 2. As a variant, the foot 3 may also project from a second side of this body 2, preferably in such a way as to offer a larger area of contact with the head. At the same time, and in the latter case, the foot 3 may have a second slit for a second section of hair, this second section also being wound about the body 2. In view of the object of the invention, notably for the sections defined either side of a parting drawn on the top of the head, one curler can be used to wind two sections. In this case fewer curlers according to the invention are needed to treat all the hair. As another variant, one curler is sufficient to wind two or even more sections if it has a sufficient number of slits, with these slits being oriented in appropriate directions. If necessary, the teeth can also be adapted to receive the winding of all the corresponding sections.

In yet another variant, even if the foot 3 projects from only one side of the body 2, it can still have several slits such as 7 to take different juxtaposed sections. These slits can converge radially on the longitudinal axis X of the body 2.

Throughout the description and claims, expressions such as "having a", "comprising a", "including a" and the like should be regarded as synonymous with "having at least one" unless the contrary is specified.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A curler, comprising:

a body having a longitudinal axis configured so that a section of hair can be wound about the body;

a foot integral with a first axial end of the body, the foot having a surface configured to rest on the scalp; and an arm is associated with the body, the arm being capable of occupying, by deformation of at least one of the body and the arm, a position in which the arm keeps the section of hair wound around the body;

wherein:

the surface of the foot configured to rest on the scalp has a surface area greater than a surface area of a transverse section through a part of the body about which the section of hair is wound;

the foot comprises means capable of retaining a portion of the section of hair that is not wound about the body;

the arm cooperates with the body to clamp the section of hair between the body and the arm at a clamping location;

the clamping location can be varied to provide a plurality of selectable clamping locations along the body depending upon selective deformation of at least one of the arm and the body;

the body is at least partly toothed; and a width of the arm is at least as wide as a width of the body including the teeth.

2. A curler according to claim 1, wherein said surface of the foot intersects with the longitudinal axis of the body.

3. A curler according to claim 2, wherein said surface intersects with the longitudinal axis at a right angle.

4. A curler according to claim 1, wherein the foot has a slit in which the portion of the section of hair is retained.

5. A curler according to claim 4, wherein the slit has a chamfered entrance.

6. A curler according to claim 4, wherein the slit forms a V-shaped indentation.

7. A curler according to claim 4, wherein the slit opens out at a distance spaced from a junction between the body and the foot.

8. A curler according to claim 1, wherein the foot has a portion that extends sideways beyond the perimeter of the body and wherein said portion has a thickness such that a portion of the section of hair is held straight out from the scalp.

9. A curler according to claim 8, wherein the portion of the foot has a slit in which the portion of the section of hair is retained, and wherein the slit extends to said surface.

10. A curler according to claim 1, wherein the foot is elastically deformable.

11. A curler according to claim 1, wherein the body is at least partly made of an elastically deformable material.

12. A curler according to claim 11, wherein the body is at least partially formed of an elastomer.

13. A curler according to claim 11, wherein the body is at least partially formed of a foam material.

14. A curler according to claim 1, wherein the foot and the body are made of the same material.

15. A curler according to claim 1, wherein the foot has essentially a parallelepiped shape.

16. A curler according to claim 1, wherein the foot is joined to one end of the body relative to the longitudinal axis.

17. A curler according to claim 1, wherein the foot is adhesively bonded to the body.

18. A curler according to claim 1, wherein the foot is welded by ultrasound welding to the body.

19. A curler according to claim 1, wherein the foot and the body are monolithic.

20. A curler according to claim 1, wherein the foot and the body are stamped out of a panel having at least two flat faces parallel with each other.

21. A curler according to claim 1, wherein the body includes teeth located on opposite sides of the body and offset with respect to each other so that the arrangement of said teeth forms a crude screw thread.

22. A curler according to claim 1, wherein the teeth are provided on at least two sides of the body and the teeth on a first side are offset from the teeth on a second side.

23. A curler according to claim 1, wherein the body is configured such that the section of hair is wound helically about the longitudinal axis of the body.

24. A curler according to claim 1, wherein the body comprises an impermeable outer wall.

25. A curler according to claim 1, wherein the arm is positioned at a second axial end of the body at a location spaced from the first axial end along the longitudinal axis.

26. A curler according to claim 1, wherein the body includes a stiffener capable of being deformed semi-permanently so as to maintain the deformation of the body to allow the arm to keep the section of hair wound about the body.

27. A curler according to claim 26, wherein the stiffener comprises a long thin core inside the body and elongated along the longitudinal axis.

28. A curler according to claim 27, wherein the stiffener is at least partially formed of a wire.

29. A curler according to claim 26, wherein the stiffener extends to a surface at the first end of the body, where it is masked by the foot.

30. A curler according to claim 1, wherein the body has a thickness in a direction orthogonal to the longitudinal axis which is the same as the thickness of said foot in a direction parallel to said longitudinal axis.

31. A curler according to claim 1, wherein the arm extends from a second axial end of said body, and wherein the arm includes a free end which is selectively positionable at different locations along the body to vary a clamping location between said arm and said body.

32. A curler according to claim 1, wherein the foot includes a slit, said slit including two borders in contact with each other in an initial position, wherein said foot is formed of an elastically deformable material such that said two borders are separable so as to receive a portion of hair, and wherein said elastically deformable material continuously urges said two borders to said initial position.

33. A curler according to claim 1, wherein the foot is formed of an elastically deformable material and includes a slit formed of two opposing borders, and wherein said two opposing borders of said slit tend at all times to an initial position of contact with each other.

34. A curler according to claim 1, wherein the foot is formed of an elastically deformable material and includes a slit formed of two opposing borders, wherein said two opposing borders are in contact with each other in an initial position in which the slit does not retain any hair, wherein said two opposing borders are not in contact with each other in a retaining position in which the slit retains a section of hair, and wherein said two opposing two borders of said slit tend at all times to said initial position of contact with each other.

35. A curler according to claim 1, wherein the body is a single integral piece that includes a plurality of surface irregularities configured to receive the section of hair.

36. A curler according to claim 1, wherein the body is not formed by bending a frame so as to form a plurality of loops.

37. A curler according to claim 1, wherein the body is a monolithic structure that includes a plurality of irregularities integral with the body.

38. A curler according to claim 37, wherein the plurality of irregularities integral with the body are teeth.

39. A curler, comprising:

a body configured so that a section of hair can be wound about the body, the body including a first end and a second end;

a foot coupled to the body adjacent to said first end; and an arm associated with the body, the arm cooperating with the body to clamp the section of hair between the body and the arm at a clamping location;

wherein:

the foot comprises a portion extending transversely to the body;

the foot includes a portion that retains a portion of the section of hair that is not wound about the body; and the clamping location can be varied so that a plurality of said clamping locations can be selected at different locations along the body;

the body is at least partly toothed; and a width of the arm is at least as wide as a width of the body including the teeth.

40. A curler as recited in claim 34, wherein said body includes at least one toothed surface and at least one non-toothed surface, and wherein said arm is positioned with respect to said body such that at least one of the plurality of clamping locations is along the at least one non-toothed surface.

41. A curler according to claim 39, wherein said body is deformable.

42. A curler according to claim 39, wherein said arm is deformable.

43. A curler according to claim 39, wherein the clamping location is selected by selecting a location to deform the arm relative to the body such that the section of hair is clamped between said arm and said body at a desired clamping location.

44. A curler according to claim 39, wherein said arm includes a first end coupled to the second end of the body, and wherein the arm includes a second free end, and wherein the second free end of the arm is selectively positionable at different locations along the body by deforming said arm.

45. A curler according to claim 39, wherein said foot includes at least one opening to receive part of the section of hair, and wherein said foot, said arm, and said body are formed of the same material.

46. A curler according to claim 39, wherein said body includes two flat, mutually parallel faces that extend parallel to a longitudinal axis of said body.

47. A curler according to claim 46, wherein said body includes a long thin core elongated along the longitudinal axis.

* * * * *